US007350465B2

(12) United States Patent
Keegstra et al.

(10) Patent No.: US 7,350,465 B2
(45) Date of Patent: Apr. 1, 2008

(54) EXTENDED RANGE LESS LETHAL PROJECTILE

(76) Inventors: Neil Keegstra, 36 Ivy Pl., Glenwood, NJ (US) 07418; Randy R. Fritz, 101 Dogtown Rd., Bloomsburg, PA (US) 17815; Robin A. Fritz, 109 Dogtown Rd., Bloomsburg, PA (US) 17815; Anthony Edward Kinchin, 12 Slaney Road, Walsall, West Midlands WS2 9AF (GB)

( * ) Notice: Subject to any disclaimer, the term of this patent is extended or adjusted under 35 U.S.C. 154(b) by 0 days.

(21) Appl. No.: 10/748,943

(22) Filed: Dec. 29, 2003

(65) Prior Publication Data

US 2005/0155511 A1 Jul. 21, 2005

(51) Int. Cl.
*F42B 12/74* (2006.01)
*F42B 8/12* (2006.01)
*F42B 30/02* (2006.01)

(52) U.S. Cl. ..... 102/502; 102/439; 102/517

(58) Field of Classification Search ..... 102/515–517, 102/465, 527, 430–431, 439, 444, 498, 529, 102/502, 436
See application file for complete search history.

(56) References Cited

U.S. PATENT DOCUMENTS

| | | | | | |
|---|---|---|---|---|---|
| 119,357 | A | * | 9/1871 | Hobbs | 102/444 |
| 3,058,420 | A | * | 10/1962 | Tanner et al. | 102/439 |
| 3,062,145 | A | * | 11/1962 | Morgan et al. | 102/436 |
| 3,146,712 | A | * | 9/1964 | Eisinger et al. | 102/444 |
| 3,342,134 | A | * | 9/1967 | Stadler et al. | 102/444 |
| 3,650,213 | A | * | 3/1972 | Abbott et al. | 102/439 |
| 3,732,821 | A | * | 5/1973 | Royer | 102/431 |
| 3,848,350 | A | * | 11/1974 | Seminiano | 102/444 |
| 3,865,038 | A | * | 2/1975 | Barr | 102/502 |
| 3,952,662 | A | | 4/1976 | Greenlees | |
| 4,043,267 | A | * | 8/1977 | Hayashi | 102/439 |
| 4,173,930 | A | | 11/1979 | Faires, Jr. | |
| 4,391,199 | A | * | 7/1983 | Morin | 102/444 |
| 4,471,699 | A | * | 9/1984 | Turco et al. | 102/501 |
| 4,546,704 | A | * | 10/1985 | Ballreich et al. | 102/444 |
| 4,593,621 | A | | 6/1986 | Buchner | |
| 4,676,169 | A | * | 6/1987 | Maki | 102/439 |
| 4,779,535 | A | * | 10/1988 | Maki | 102/439 |
| 4,823,702 | A | | 4/1989 | Woolsey | |
| 4,996,924 | A | * | 3/1991 | McClain | 102/501 |
| 5,086,703 | A | * | 2/1992 | Klein | 102/502 |
| 5,200,573 | A | | 4/1993 | Blood | |
| 5,225,628 | A | | 7/1993 | Heiny | |
| 5,259,319 | A | * | 11/1993 | Dravecky et al. | 102/447 |
| 5,343,850 | A | * | 9/1994 | Steer | 124/64 |
| 5,353,712 | A | * | 10/1994 | Olson | 102/517 |
| 5,361,700 | A | | 11/1994 | Carbone | |
| 5,361,701 | A | * | 11/1994 | Stevens | |
| 5,479,861 | A | * | 1/1996 | Kinchin | 102/439 |

(Continued)

FOREIGN PATENT DOCUMENTS

FR 2639104 A3 * 5/1990

*Primary Examiner*—Bret Hayes
(74) *Attorney, Agent, or Firm*—Hoffmann & Baron, LLP

(57) ABSTRACT

An extended range munition including a projectile having a generally cylindrical body includes a forward end and rearward end. The forward end includes a protruding member extending therefrom, thereby increasing the weight of said body and said forward end. The body is formed of a non-metallic material having a durometer hardness less than conventional metallic projectile.

5 Claims, 3 Drawing Sheets

U.S. PATENT DOCUMENTS 5,565,649 A * 10/1996 Tougeron et al. ..... 102/502
5,691,501 A * 11/1997 Gilbert ..... 102/444
6,041,712 A * 3/2000 Lyon ..... 102/439
6,067,909 A * 5/2000 Knoster, Jr. ..... 102/517
6,164,209 A 12/2000 Best et al.
6,189,454 B1 * 2/2001 Hunt ..... 102/444
6,202,562 B1 3/2001 Brunn et al.
6,240,850 B1 * 6/2001 Holler ..... 102/439
6,283,037 B1 9/2001 Sclafani
6,527,880 B2 * 3/2003 Amick ..... 148/423
6,546,874 B2 4/2003 Vasel et al.
6,615,739 B2 * 9/2003 Gibson et al. ..... 102/444
6,782,828 B2 * 8/2004 Widener ..... 102/502

* cited by examiner

EXTENDED RANGE LESS LETHAL PROJECTILE

FIELD OF THE INVENTION

The present invention relates generally to a munition designed to impact a target with low lethality. More particularly, the present invention relates to a less-lethal projectile having extended range capabilities.

BACKGROUND OF THE INVENTION

There is a well established need to provide a munition, having a projectile which can impact a target with a low likelihood of inflicting a lethal blow. The need for such a munition can be seen in numerous situations such as military and police applications, self-defense and even animal control. A desirable, less-lethal munition would be able to impart a stopping or disabling force on the target.

The art includes numerous examples of various projectiles, which are designed to impact the target with a less lethal force. One type of shotgun round designed for less lethal applications includes substituting a conventional shot gun slug with a flexible deformable sack which may contain particulate matter. The sack is designed to deform upon impact with the target, imparting a blow without significant penetration. Examples of such less lethal rounds are shown in U.S. Pat. Nos. 6,202,562 and 6,283,037.

Other examples of less-lethal shot gun rounds include slugs manufactured from deformable materials, which deform or spread out upon impact, thereby reducing incidences of penetration upon impact. An example of such rounds are shown in U.S. Pat. Nos. 3,952,662 and 5,691,501. Additionally, other rounds include destructible slugs carrying fluid or other substances within. Recreational paint balls are an example of such destructible projectiles and which are shown for example in U.S. Pat. Nos. 5,254,379 and 6,546,874.

Each of the projectiles of the prior art, which are designed to be less lethal, suffer from certain disadvantages. First, the projectile or slug itself is complicated and expensive to manufacture, as compared with traditional shot gun slugs. Second, many of the known, less-lethal rounds require use of specialized non-standard weapons. Lastly, most of the available shot gun rounds are not accurate over an extended range. This greatly reduces the effectiveness of the round.

It is, therefore, desirable to provide a less-lethal munition projectile which is easy to manufacture and provides effective, less-lethal impact over an extended range.

SUMMARY OF INVENTION

The present invention provides an extended range munition of low lethality. The munition includes a projectile having a generally cylindrical body with a forward end and a rearward end. The forward end includes an extending protruding member to increase the weight of the body at the forward end. The body is formed of a light weight low durometer non-metallic material which dissipates energy upon impact.

In a preferred embodiment the outer wall of the body may be dimpled. Also the rearward end of the body may include a hollow bore.

The present invention additionally provides a less-lethal shot gun round. The round includes a generally tubular hull having a forward end and an opposed rearward end. A base encloses the rearward end of the hull. A propellant is contained within the base. A wad is sealably positioned in the hull adjacent to rearward end. A projectile slug is carried in the hull. The slug is generally a cylindrical member, having an outer cylindrical wall. The slug further includes a solid head at a forward end of the cylindrical member, thereby increasing the weight of the slug at the forward end. The slug is formed of nonmetallic material having a durometer hardness less than conventional shot gun slug materials

DETAILED DESCRIPTION OF THE PREFERRED EMBODIMENTS

The present invention directed to an extended range less-lethal munition projectile. The projectile of the present invention may be fired from various weapons. The type of weapon employed dictates the type of cartridge in which the projectile is placed. For simplicity of description the projectile will be described with respect to a shot gun slug. It may be appreciated, however, that the present invention is not limited thereto.

Figure 1:
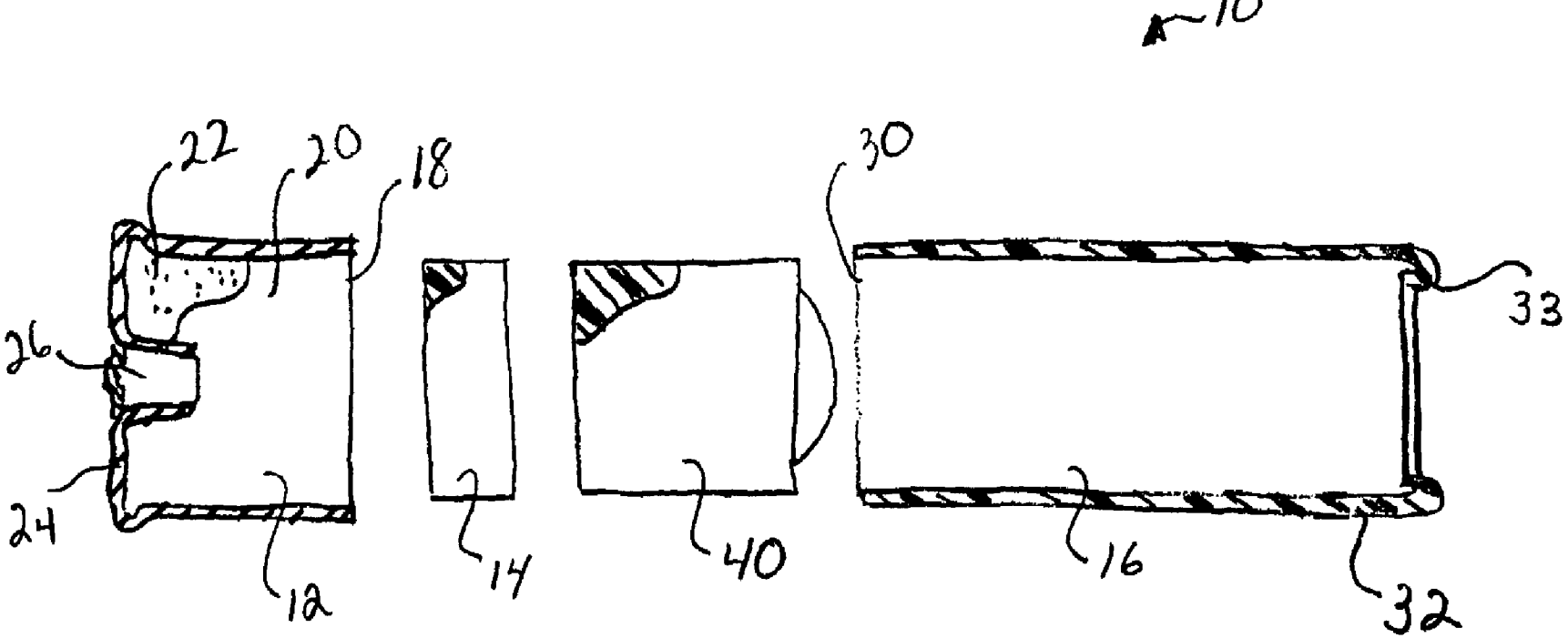
FIG. 1 is an exploded view partially in section of an extended range munition projectile of the present invention in the form of a shot gun round.

As is shown in FIG. 1, round 10 of the present invention may include a base 12, a wad 14 and a hull 16, all of generally conventional construction. Such construction is shown for example in U.S. Pat. No. 6,202,562, issued Mar. 20, 2001, to Brunn et al and entitled, "Methods of Preparing a Low Lethally Projectile for Flight", and U.S. Pat. No. 6,546,874, issued Apr. 15, 2003 to Vasel et al, entitled, "Non-lethal Projectile for Delivering an Inhibiting Substance to a Living Target," incorporated herein for all purposes.

Base 12, which is generally formed of metallic material, preferably brass, is a cup shape member having an open upper end defining a base interior 20. Base interior 20 supports a propellant 22, which is generally an explosive charge. The base 12 also supports at a lower end 24 thereof a primer 26, which when struck, ignites the propellant. A wad 14 interposed between base 12 and hull 16 which sealably contains propellant 22 in compression sealing it from the hull. As shown herein by way of example, wad 14 is a generally disk shape, plastic member. However, as is well known in the art and as is shown further herein below, wad 14 may take various sizes, shapes and constructions, depending upon the application of the round. Hull 16 is an elongate, tubular member having an open end 30 adjacent base 12 and an opposed crimped, closed end 32. Hull 16 of the present invention is typically formed of a plastic material. However, as is well known in the art, other materials and constructions for hull 16 may also be employed. In accordance with the present invention, hull 16 is designed to support one or more non-lethal projectile shot gun slugs 40.

Figure 4:
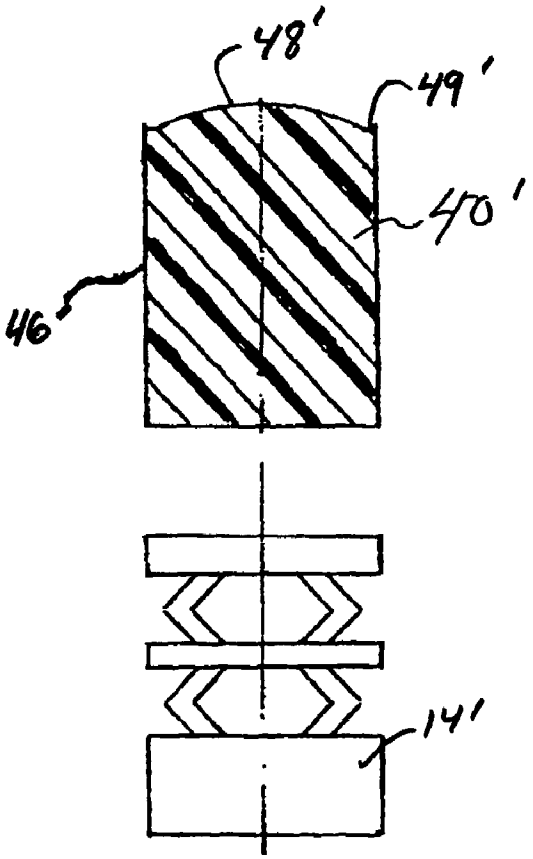
FIGS. 2-4 show a shot gun slug of the present invention in combination with a wad.

Referring more specifically to FIGS. 2-5, the projectile slug 40 of the present invention is shown. Slug 40 is a generally, elongate cylindrical member having a forward or front end 42 and a rearward end 44. An outer cylindrical wall 46 extends between the two ends. The forward end 42 of slug 40 includes an outwardly extending dome shaped element 48 about a rim 49, so that slug 40 has the size and shape of a conventional lead shot gun slug. The slug 40 may include a generally cylindrical bore 50, extending partially through the body of slug 40, and opening at end 44. The particular construction of the slug, shown in FIGS. 2 and 3, results in the forward end 42 of the slug having an increased weight. Such weight distribution is provided in part by the hollow cylindrical bore adjacent end 44, as well as the dome shaped element 48 extending from end 42. The weight distribution of the slug of the present invention is such that its weight is biased—forwardly. The nose forward aerodynamics (similar to a badminton shuttlecock) allows the slug to function as an accurate projectile when fired, with little or no distortion in its flight path over an extended range. While the hollow bore 50 helps in weight distribution, it is contemplated that an aerodynamically stable slug may be provided which is completely solid, such as shown in FIG. 4. Slug 4' of FIG. 4 is identical to slug 40 of FIGS. 2 and 3. However, the central bore 50 has been eliminated and the slug is completely solid.

As shown in FIGS. 2-5, the large frontal area and the domed element 48 provides a greater frontal surface area than a flat surface. This helps dissipate energy on impact. In situations where the hull 16 includes a roll crimp 33, the rim 49 serves to open the roll crimp upon firing.

Figure 3:
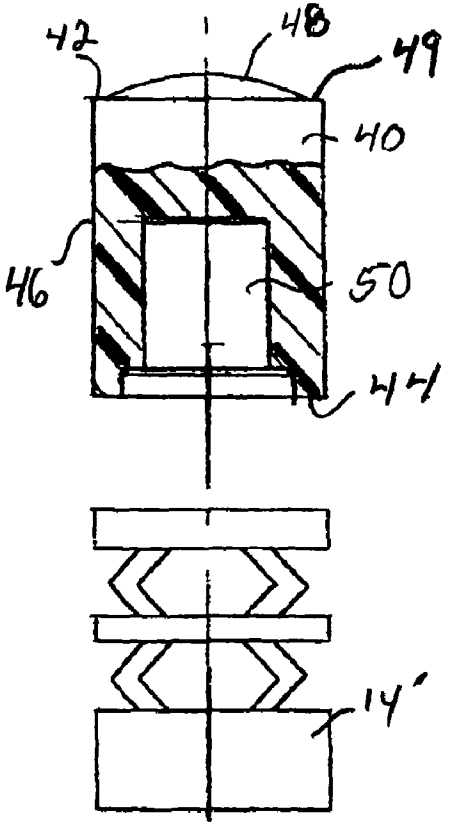
Figure 2:
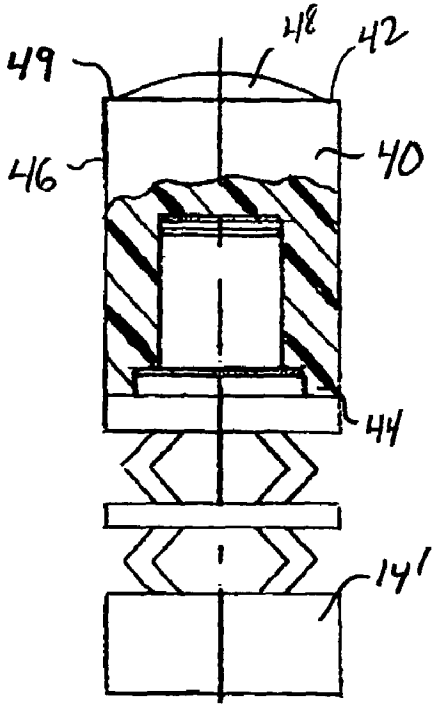

FIGS. 2, 3 and 4 also show further embodiments of the wad, which may be employed by the slug of the present invention. Pressure wad 14' is of the type more specifically shown and described in U.S. Pat. No. 6,502,516, issued Jan. 7, 2003, entitled, "Sabot Shot Gun Slug Assembly," which is incorporated by reference herein for all purposes. The wad may be attached to the slug as shown in FIG. 2, or may be a separate member, as shown in FIGS. 3 and 4.

The less lethal shot gun slug of the present invention, while shaped to mimic a conventional lead shot gun slug of similar size, is formed of a material having low velocity and is resistant to target penetration upon impact. Preferably, the slug of the present invention may be formed from a plastic material or other natural or synthetic materials having a low hardness, such as rubber, foam or a wide variety of plastics.

It is contemplated that preferable results are obtained with materials having a durometer hardness, ranging from about between 20 and 90. With this construction and hardness of material, the plug 40 of the present invention will impact the target with low lethality and less incidences of penetration.

The present invention also contemplates modifying the outside cylindrical surface of slug 40.

Figure 5:
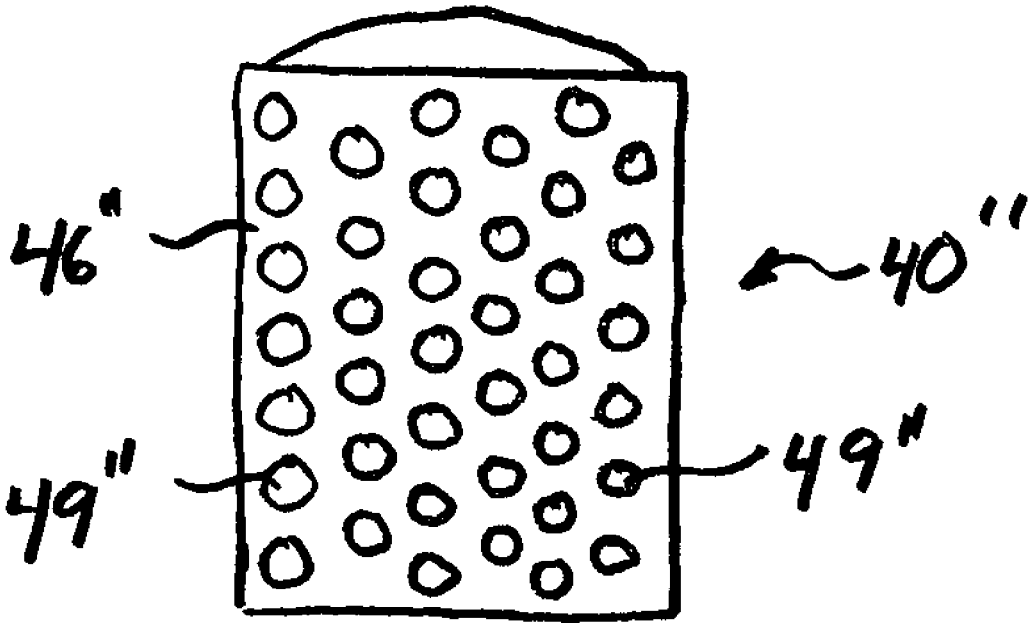
FIG. 5 shows an alternate embodiment of the shot gun slug of FIGS. 2-4.

Referring now to FIG. 5, slug 40" is shown. Slug 40" provides for a dimpled cylindrical wall 46". Dimples 49", which may be formed uniformly along the outer surface of the slug. The dimples 49" reduce the weight of the slug. Also the dimples 49" reduce barrel friction upon firing. This reduces the charge required to establish the requisite velocity needed for firing. Such lower velocity is advantageous in firing less-lethal slugs.

Thus, the present invention provides an aerodynamic, extended range projectile of low lethality, which has a configuration which mimics a conventional slug of similar size, so that conventional weapons may be employed to fire the round.

What is claimed is:

1. A less-lethal shot gun round comprising:

a generally elongate tubular hull having a forward end and an opposed rearward end, said hull including a roll crimp at said forward end thereof;

a base enclosing said rearward end of said hull;

a propellant contained within said base;

a wad sealably positioned in said hull adjacent said rearward end;

a penetration-resistant kinetic energy projectile carried in said hull, said projectile being a generally cylindrical member having an outer cylindrical wall, said projectile having a rearward end and a forward end with a hollow cylindrical bore extending into said rearward end of said projectile and further including a convex solid head at said forward end of said projectile, such that the center of mass of said projectile is closer to said forward end of said projectile than to said rearward end of said projectile, thereby increasing the weight of said projectile at said forward end of said projectile, said forward end of said projectile defining a rim about said convex solid head; and said rim supporting said roll crimp and configured to open said roll crimp upon firing, said projectile being formed of a homogeneous non-metallic material having a durometer hardness of between about 20 and 90, said durometer hardness being less than that of conventional shot gun projectile materials.

2. A less-lethal shot gun round of claim 1, wherein said outer cylindrical wall is dimpled.

3. A less-lethal shot gun round of claim 1, wherein said projectile is manufactured of material molded from the group consisting of rubber, foam and plastic.

4. A less-lethal shot gun round of claim 1, wherein said non-metallic material has a mass that is less than that of conventional shot gun projectile materials.

5. A less-lethal shot gun round of claim 1, wherein said non-metallic material has a density that is less than that of conventional shot gun projectile materials.

* * * * *